US007077386B1

(12) United States Patent
Gray, Jr. et al.

(10) Patent No.: US 7,077,386 B1
(45) Date of Patent: Jul. 18, 2006

(54) ADJUSTABLE STAIRCASE RAIL SYSTEM

(75) Inventors: John M. Gray, Jr., Marion, VA (US); David J. Wynne, Abingdon, VA (US)

(73) Assignee: Harris Trust and Savings Bank, Chicago, IL (US)

( * ) Notice: Subject to any disclaimer, the term of this patent is extended or adjusted under 35 U.S.C. 154(b) by 0 days.

(21) Appl. No.: 10/979,436

(22) Filed: Nov. 2, 2004

Related U.S. Application Data

(62) Division of application No. 10/118,884, filed on Apr. 9, 2002.

(51) Int. Cl.
*E04H 17/14* (2006.01)

(52) U.S. Cl. ..... 256/67; 256/65.03; 256/65.07; 403/15; 403/157

(58) Field of Classification Search ..... 403/150, 403/152, 155, 157; 16/378, 379, 382; 256/67, 256/65.01, 65.02, 65.03, 65.07, 65.08, 65.14
See application file for complete search history.

(56) References Cited

U.S. PATENT DOCUMENTS

| | | | | | |
|---|---|---|---|---|---|
| 1,234,674 | A | | 7/1917 | Lachman | 256/22 |
| 2,767,959 | A | | 10/1956 | Schott | 256/19 |
| 3,004,751 | A | * | 10/1961 | Woodward | 256/67 |
| 3,007,678 | A | * | 11/1961 | Buehler | 256/65.07 |
| 3,516,644 | A | | 6/1970 | Horgan, Jr. | 256/65 |
| 4,125,249 | A | | 11/1978 | Zen | 256/67 |
| 4,150,907 | A | * | 4/1979 | Thurnauer | 403/234 |
| 4,886,245 | A | | 12/1989 | Manzo | 256/67 |
| 5,404,682 | A | * | 4/1995 | West | 52/165 |
| 5,557,893 | A | | 9/1996 | Bowls | 52/187 |
| 6,145,814 | A | | 11/2000 | Perrot | 256/67 |
| 6,341,764 | B1 | | 1/2002 | Conner | 256/65 |

* cited by examiner

*Primary Examiner*—Daniel P. Stodola
*Assistant Examiner*—Michael P. Ferguson
(74) *Attorney, Agent, or Firm*—Kennedy Covington Lobdell & Hickman, LLP

(57) ABSTRACT

A hinge assembly which can be inserted into the bore of an end-bored bluster, fastened to the inside of the bore, and pivotally attached to a flange suitable for attachment to a rail. The hinge assembly requires no external modification to the normally exposed surfaces of the baluster. The flange includes an H-shaped foot which may be concealed in a groove defined by a hand rail or a shoe rail. The pivot point is raised slightly above the inner surface of the groove to prevent any unsightly gap, termed "bird's' mouth" in the industry, adjacent the baluster.

4 Claims, 8 Drawing Sheets

ADJUSTABLE STAIRCASE RAIL SYSTEM

This application is a divisional of prior U.S. patent application Ser. No. 10/118,884, filed Apr. 9, 2002, for ADJUSTABLE STAIRCASE RAIL SYSTEM co-pending herewith.

BACKGROUND OF THE INVENTION

1. Technical Field

This invention generally relates to the construction of staircase balustrades and, more particularly, to components and systems for pivotally attaching a baluster to a hand rail, a shoe rail or a cap rail in a staircase rail system so as to adjust for the rake angle of an individual staircase.

2. Background

Staircases typically include a staircase rail system for decoration and safety. In the staircase rail system, a row of vertical posts is conventionally topped by a hand rail along the edge of the staircase. These posts, commonly termed balusters, are supported by relatively larger posts known as newels. The staircase member upon which a user places his or her foot is referred to as a tread. The angle of incline of a staircase is referred to as the rake. Thus, a staircase in which successive treads ascend steeply is said to have a high rake.

Each baluster is fixed to the hand rail at its upper end and to the shoe rail or tread at its lower end. This arrangement is termed an open tread staircase. Alternatively, each baluster may be fixed at its lower end to a cap rail on the staircase. This arrangement is properly termed a closed tread staircase.

In the past, it was necessary for a worker at the jobsite to accurately measure the angle between the hand rail, shoe rail or cap rail, and each of the balusters and to hand fit the balusters individually to match the rake of the particular staircase. The construction of a staircase in this traditional manner results in a high quality product with a very desirable finished appearance that has consumer appeal. However, traditional construction requires a great deal of skill and care and can be quite time consuming.

To facilitate staircase construction, systems of adjustable balusters which are pivotally attached to their rails have been disclosed, many of which can be pre-assembled for delivery to the jobsite. While offering significant improvements over traditional systems which require hand-fitting each baluster, previous adjustable balustrade systems are relatively complicated to manufacture and assemble. Also, the finished staircase produced with these previous adjustable systems does not have the same quality finish or precisely resemble the decorative appearance of traditional staircases. Consequently, these previous adjustable systems fall short of the high quality, finished appearance of a traditional hand-crafted stair rail.

Additionally, most of the previous adjustable systems are limited to use with balusters of rectangular cross-section. Because pin top balusters are associated with very fine traditional staircases, they are generally preferred by consumers.

Therefore, a need still exists for an improved hinge assembly for pivotally attaching balusters to handrails and shoe rails in a pre-assembled adjustable staircase rail system. The improved hinge assembly and staircase system should be relatively easy to manufacture and assemble, and preassembled for delivery to the jobsite. Ideally, the improved hinge assembly and staircase system presents a quality finished appearance similar to traditional hand-fitted staircases, and performs well with pin top balusters.

SUMMARY OF THE INVENTION

The invention provides hinge assemblies for insertion into a mating groove defined by a hand rail, a shoe rail or cap rail. Such assemblies permit balusters to pivot with respect to the rail before and during staircase installation, in order to adjust the rake of the balusters to the rake of a particular staircase. The hinge assemblies are not readily apparent in the finished staircase containing the hinge assembly, require no external modifications to the normally visible surfaces of the baluster, and are easily concealed in the groove of the rail. The assemblies and the rails can be preassembled as an adjustable staircase rail system for delivery to a jobsite.

In a preferred form, the hinge assembly is assembled by snapping together two identical, moldable half-cap pieces about the end of a baluster, which is pierced through by a hole. The half-caps are fixed together by press-fit mating surfaces, and fit flush within a mating groove defined by a hand rail or shoe rail. In a finished staircase containing the hinge assembly, the hole which pierces the baluster cannot be seen, and the half-caps are normally out of sight.

In a preferred embodiment, the half-caps are identical to each other, and are manufactured from a moldable polymer material using the same mold. Each of the half caps includes two substantially parallel and opposite faces. Each of the faces is generally flat and extends lengthwise along the respective half-cap. One of the faces of each half cap surrounds a recessed wall that forms a spindle projecting generally transversely relative to the plane of the face. The recessed wall also defines an ellipsoidal cavity surrounding the spindle. Each of the half-caps is fixed to the other, with the respective spindles positioned substantially in line. When the half-cap pieces are press-fit together, the spindles are inserted into the hole in the baluster to form an axis on which the baluster pivots.

With the half-caps and the pierced baluster positioned as described, wood screws are used to fasten the half-caps to the rail. This staircase rail system can be preassembled for delivery to a jobsite, and easily adjusted at the jobsite to any particular staircase rake within a range of about 32 degrees to about 45 degrees. This staircase rail system performs well with pin top balusters.

In another preferred form, the hinge assembly can be inserted into the bore of an end-bored baluster, fastened to the inside of the bore, and pivotally attached to a flange suitable for attachment to a rail. The hinge assembly requires no external modification to the externally visible surfaces of the baluster. The flange includes an H-shaped foot that is easily concealed in a groove defined by a hand rail, shoe rail or cap rail. The pivot point is raised slightly above the inner surface of the groove to prevent any unsightly gap, termed "birds' mouth", adjacent the baluster.

In this embodiment, the hinge assembly includes a plate member for inserting into and generally across an interior surface of the bore of an end-bored baluster. The plate has a face which includes a hole suitable for receiving a wood screw to fasten the plate to the inside surface of the bore. At least one tab extends from the plate at approximately a right angle to the plate face. The hinge assembly also includes a flange member having an H-shaped foot suitable for attachment to a rail. The flange defines a port providing access to the hole in the plate face. A rivet passes through a hole in the plate tab and a corresponding hole in the flange so as to pivotally attach the tab to the flange. In this way, the end-bored baluster is pivotally attached to the flange, which is secured to the rail.

The hinge assembly described above can be used to pivotally attach an end-bored baluster to a grooved rail to produce a staircase rail system that is adjustable over a range of staircase rakes. With the end-bored baluster pivotally attached to the flange as described, wood screws are used to attach the flange to an inside surface of the groove. This staircase rail system can be preassembled for delivery to a jobsite, and easily adjusted at the jobsite to any particular staircase rake within a range of about 32 degrees to about 45 degrees. This adjustable staircase rail system is a good choice for attaching rectangular balusters to hand rails, shoe rails or cap rails.

Either of the hinge assemblies described above, or variations and modifications of these assemblies, can be used alone or in combination with the others to produce a variety of adjustable staircase rail systems. Practitioners will appreciate that one or more of these adjustable staircase rail systems can facilitate the construction of almost any staircase.

DETAILED DESCRIPTION OF PREFERRED ASPECTS OF THE INVENTION

Figure 1A:
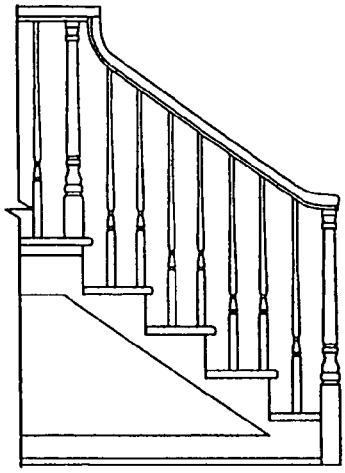
FIG. 1 is a composite view of traditional stairway designs including an elevation view of an open stairway with treads and risers visible in FIG. 1A; an elevation view of a closed stairway with treads and risers enclosed in FIG. 1B; an elevation view of a post-to-post open stairway with a handrail fitted between newel posts in FIG. 1C; and an elevation view of an over-the-post open stairway with a handrail placed on top of the newel posts in FIG. 1D.
Figure 1B:
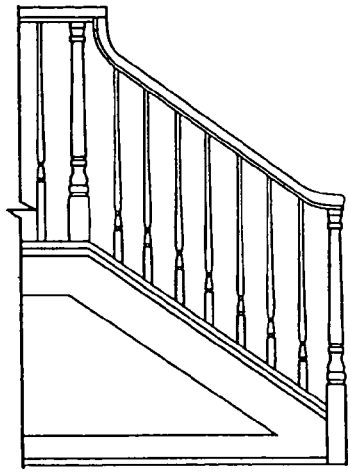
Figure 1C:
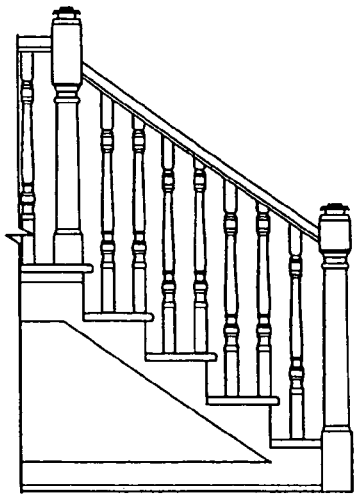
Figure 1D:
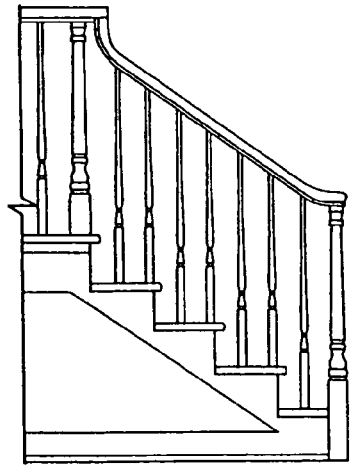
Figure 2:
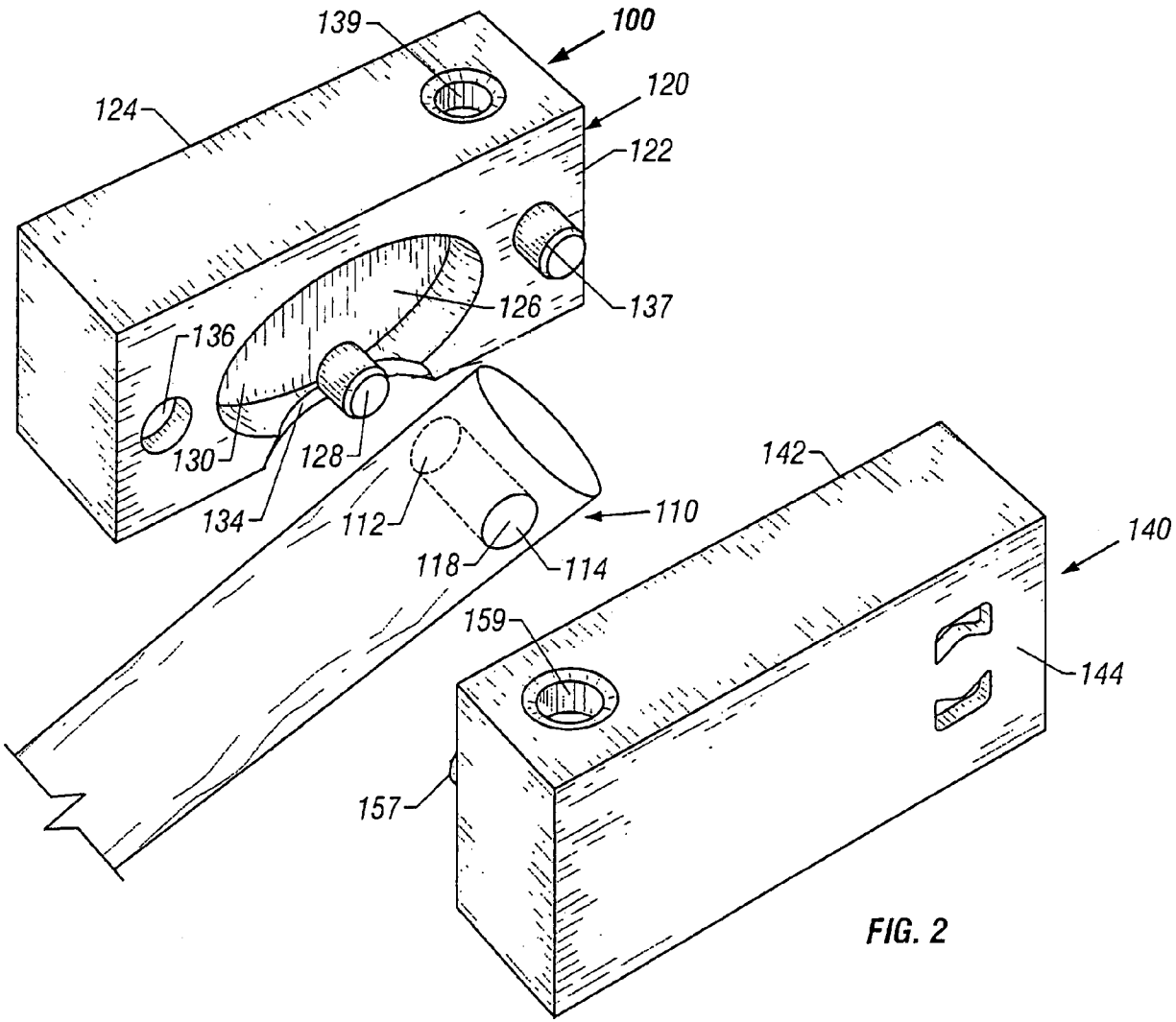
FIG. 2 is an exploded partial perspective view of a hinge assembly, which includes spindles.
Figure 3:
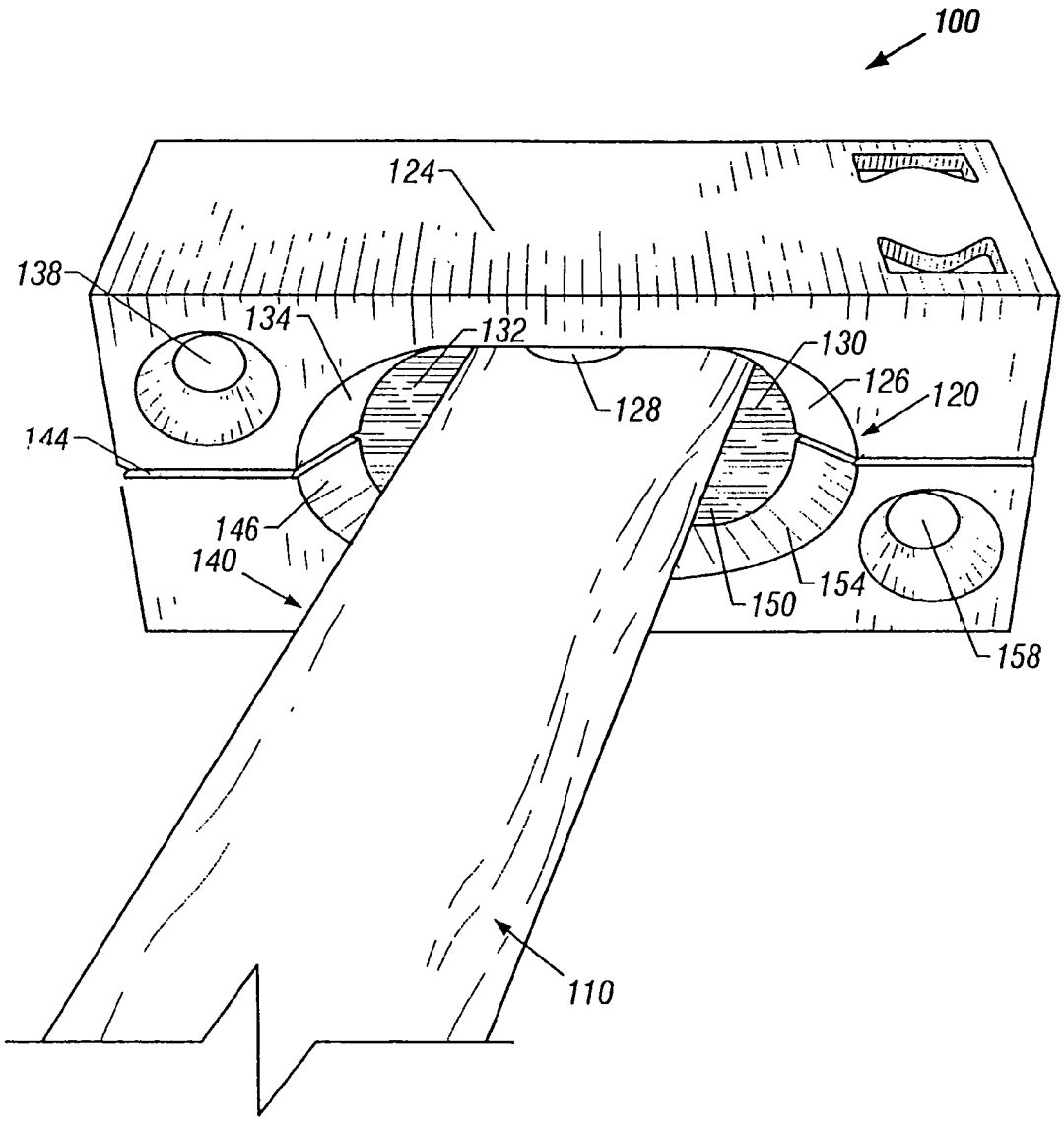
FIG. 3 is a partial perspective view of the hinge assembly depicted in FIG. 2.

In a preferred embodiment, hinge assembly 100 as depicted in FIGS. 2 and 3 comprises two substantially identical elongated half-caps 120 and 140, each of which is adapted to join with the other while substantially surrounding an end portion of pierced baluster 110. Orifices 112 and 114 are defined by baluster 110. Preferably, orifices 112 and 114 are connected by conduit 118, which extends entirely through baluster 110.

Elements of half-cap 140 that correspond to like elements of half-cap 120 have numbers which are greater than the corresponding element by 20. For example, protuberance 157 of half-cap 140 corresponds to protuberance 137 of half-cap 120, and conforms to the description of protuberance 137. As another example, passage 159 of half-cap 140 corresponds to passage 139 of half-cap 120, and conforms to the description of passage 139.

Half-cap 120 includes two substantially parallel and opposite faces 122 and 124 which extend lengthwise along half-cap 120. Face 122 substantially surrounds a recessed wall 126 of half-cap 120. Recessed wall 126 forms spindle 128 and defines cavity 130 adjacent to and surrounding spindle 128. Spindle 128 projects generally transversely relative to face 122. Cavity 130 cooperates with cavity 150 of half-cap 140 to provide ellipsoidal protected space 132 in which pierced baluster 110 is free to turn about an axis of rotation formed by spindle 128 and passing through orifices 112 and 114.

Similarly, half-cap 140 includes two substantially parallel and opposite faces 142 and 144 which extend lengthwise along half-cap 140. Face 142 substantially surrounds recessed wall 146 (not shown) of half cap 140. Recessed wall 146 forms spindle 148 (not shown) and defines cavity 150 (see FIG. 3) adjacent to and surrounding spindle 148. Spindle 148 projects generally transversely relative to face 142.

With the pair of half-caps abutting at faces 122 and 142, lips 134 and 154 of recessed walls 126 and 146, respectively, form an oval-shaped mouth through which baluster 110 extends into space 132. Adjacent the major axis of the oval-shaped mouth, lips 134 and 154 slope away from spindles 128 and 148 in order to match the arc described by baluster 110 as it turns. Adjacent the minor axis of the mouth, lips 134 and 154 fit closely with the one end of the baluster which extends into space 132. These details contribute to the high quality and finished appearance of hinge assembly 100, because the half-caps 120 and 140 fit relatively closely to baluster 110 as it pivots.

Figure 5:
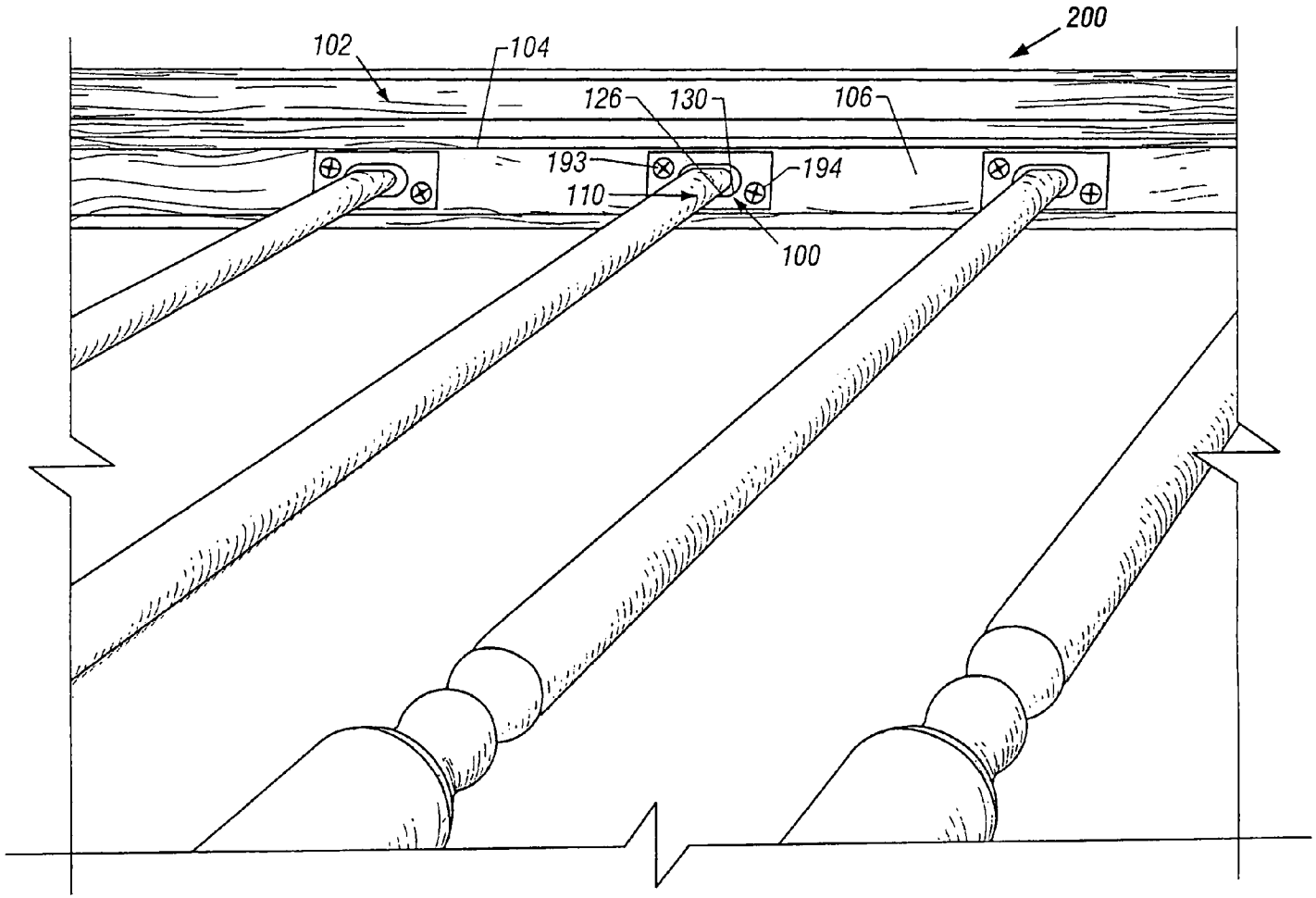
FIG. 5 is a partial perspective view of an adjustable stair rail system utilizing the hinge assembly depicted in FIG. 2.

Half-caps 120 and 140 are preferably composed of a moldable polymer which accepts stain so as to blend in with the color of rail 102 (see FIG. 5). Before staining, half-caps 120 and 140 may be the color of unfinished red oak. Because half-caps 120 and 140 are identical to each other, they can both be produced from the same mold, reducing production costs and lessening potential inventory problems.

In order to fix half caps 120 and 140 in place relative to each other, half cap 120 defines aperture 136 for receiving and producing an interference fit with protuberance 157 of half-cap 140. For the same purpose, half-cap 140 defines aperture 156 (not shown) for receiving and producing an interference fit with protuberance 137 of half-cap 120. These interference fits enable half-caps 120 and 140 to literally snap together (see FIG. 3). Alternatively, screws, nails, hooks, magnets, clips and other fasteners can be used to hold half-caps 120 and 140 together on opposite sides of baluster 110. Half-caps 120 or 140 can be removably fixed or, alternatively, permanently fixed to each other. However, removably fixing half-caps 120 and 140 to each other is presently preferred because it simplifies assembly of hinge assembly 100.

Passages 139 and 159 extend completely through half-caps 120 and 140, respectively, to receive wood screws 193 and 194 for attaching the half caps to rail 102 (see FIG. 5). Alternatively, half-caps 120 and 140 can be attached to rail 102 with a nail, an adhesive, a bolt, a molly bolt or other fastener.

When assembled for use as shown in FIG. 3, half-caps 120 and 140 are snapped together with the axes of spindles 128 and 148 substantially in line with respect to each other so that the spindles can be at least partially (and preferably entirely) inserted into the respective orifices 112 and 114 of baluster 110 to pivotally support baluster 110. Cavities 130 and 150 cooperate to provide a protected space in which the end portion of baluster 110 is free to turn about an axis of rotation passing through spindles 128 and 148.

As shown in FIG. 5, with the half-caps 120 and 140 pressed together around the top of baluster 110, the half caps fit flush with the bottom of rail 102, and are sized so that faces 124 and 144 fit snugly within groove 104 defined by rail 102. Alternatively, half-caps 120 and 140 can be sized so that faces 124 and 144 fit snugly within an opening of any shape defined by rail 102. This snug fit tends to hold half caps 120 and 140 in proper fixed relation to each other, reinforcing the effect of the interference fits provided by aperture 136 with protuberance 157, and by aperture 156 with protuberance 137.

Baluster 110 is depicted in FIGS. 2 and 3 as having a generally circular cross-section along the axes of spindles 128 and 148. Accordingly, baluster 110 is depicted in FIGS. 2 and 3 as a pin top baluster. However, the invention may be practiced successfully with a pierced baluster having a generally elliptical cross-section or a generally polygonal cross-section along the axes of the spindles 128 and 148. For example, the invention may be practiced with a pierced baluster having a generally rectangular cross-section.

It is also contemplated in another embodiment that only one of the half-caps 120 or 140 comprises a spindle, such as spindle 128 or 148, for pivotally securing the pierced end of baluster 100. That is, a spindle 128 or 148 would project from the interior surface of only one of the half-caps 120 or 140, respectively, through an orifice provided in the top of baluster 110. It is also contemplated in yet another embodiment that only one of the half-caps comprises a means for attaching the hinge assembly to a rail, such as passage 139 or 159.

Figure 4:
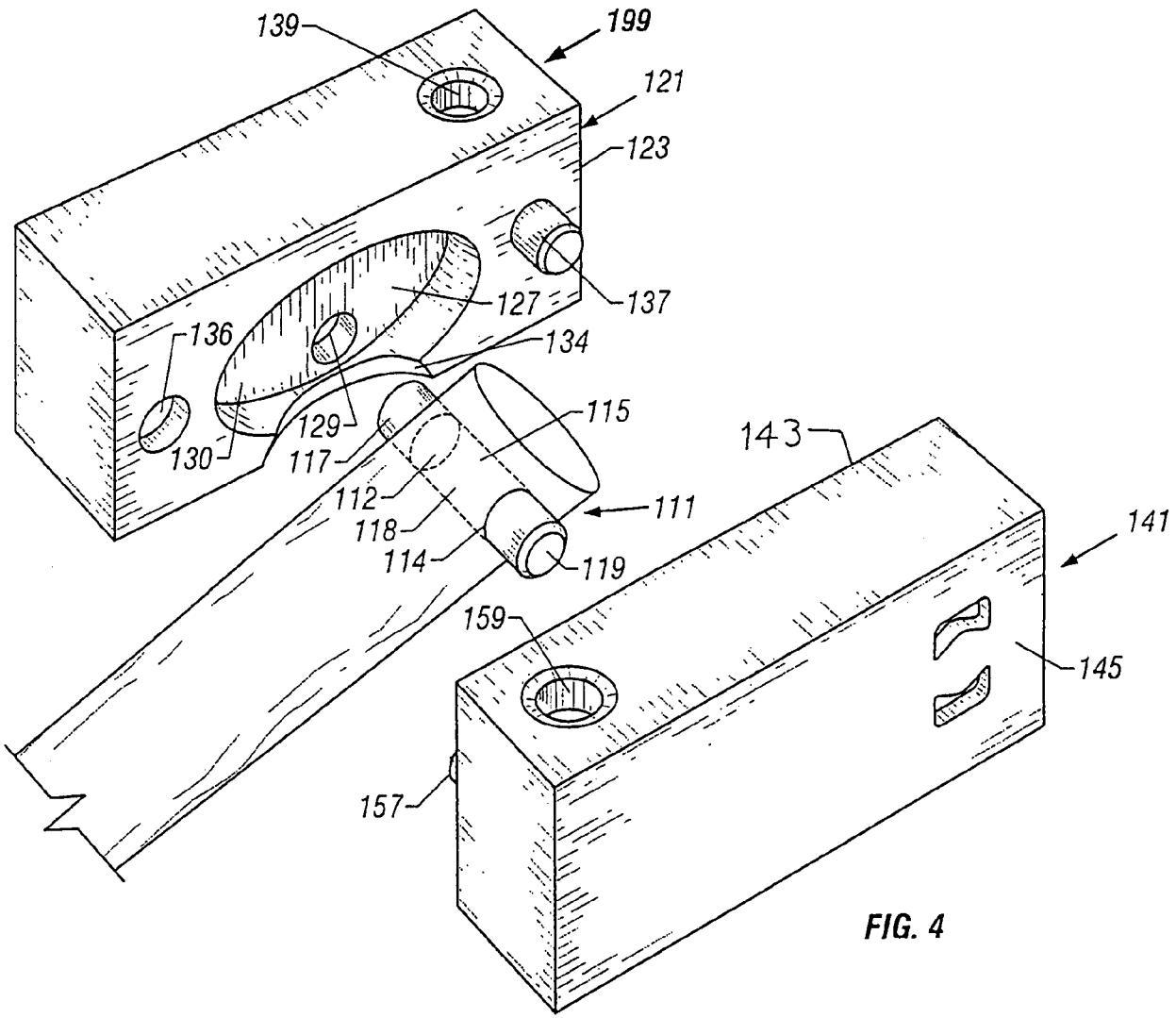
FIG. 4 is an exploded partial perspective view of a hinge assembly, which includes receptacles.

Another preferred embodiment is substantially the same as hinge assembly 100, except that the half-caps include receptacles rather than spindles and the baluster includes projections rather than orifices. Hinge assembly 199 as depicted in FIG. 4 comprises half-cap 121, which includes face 123 surrounding recessed wall 127. Receptacle 129 is formed by recessed wall 127. Half-cap 141 is preferably substantially identical to half-cap 121. Elements of half-cap 141 that correspond to an element of half-cap 121 have numbers which are greater by 20 than the number of the corresponding element. For example, protuberance 157 of half cap 141 corresponds to protuberance 137 of half-cap 121, and conforms to the description of protuberance 137. As another example, passage 159 of half-cap 141 corresponds to passage 139 of half-cap 121, and conforms to the description of passage 139. Half-cap 141 includes face 143 (not shown) surrounding recessed wall 147 (not shown) which forms receptacle 149 (not shown).

As shown in FIG. 4, baluster 111 includes projections 117 and 119 formed as ends of axle 115, which traverses conduit 118. Orifices 112 and 114 are depicted as mouths of conduit 118. Alternatively, integral portions of baluster 111 can be formed as projections 117 and 119. In either case, receptacles 129 and 149 are of appropriate size and shape to receive projections 117 and 119, respectively, in a manner which permits baluster 111 to turn about the axes of projections 117 and 119.

It is also contemplated that only one of the half-caps may comprise a receiving receptacle, such as receptacle 129 or 149, and baluster 111 includes only one projection 117 or 119 for cooperation with the receiving receptacle. Also, only one of the half-caps may comprise a means for attaching the hinge assembly to a rail, such as passage 139 or 159.

Attaching either hinge assembly 100 or 199 to a rail, such as rail 102, provides an adjustable staircase system. One such adjustable staircase system, designated system 200, is depicted in FIG. 5. With baluster 110 and half-caps 120 and 140 assembled as described above to form hinge assembly 100, wood screws 193 and 194 are inserted through passages 139 and 159 in order to fasten half-caps 120 and 140 to rail 102. System 200 can be preassembled for delivery to a jobsite, and easily adjusted at the jobsite to any particular staircase rake within a range of up to about 40 degrees. This staircase rail system performs well both with pin top balusters and with rectangular balusters. As shown in FIG. 5, fillet 106 fits in groove 104 adjacent hinge assembly 100. Fillet 106 can be installed at the factory in order to save time at the jobsite.

Although baluster 110 is depicted as a having a pin top in FIGS. 2, 3, 4 and 5, the invention may alternatively be practiced with a pierced baluster having a generally elliptical cross-section or a generally polygonal cross-section along the axes of spindles 128 and 148. Although rail 102 is depicted as a hand rail in FIG. 5, the invention may be practiced with a shoe rail for assembly on open tread applications, or a cap rail for assembly on closed tread applications.

Figure 6:
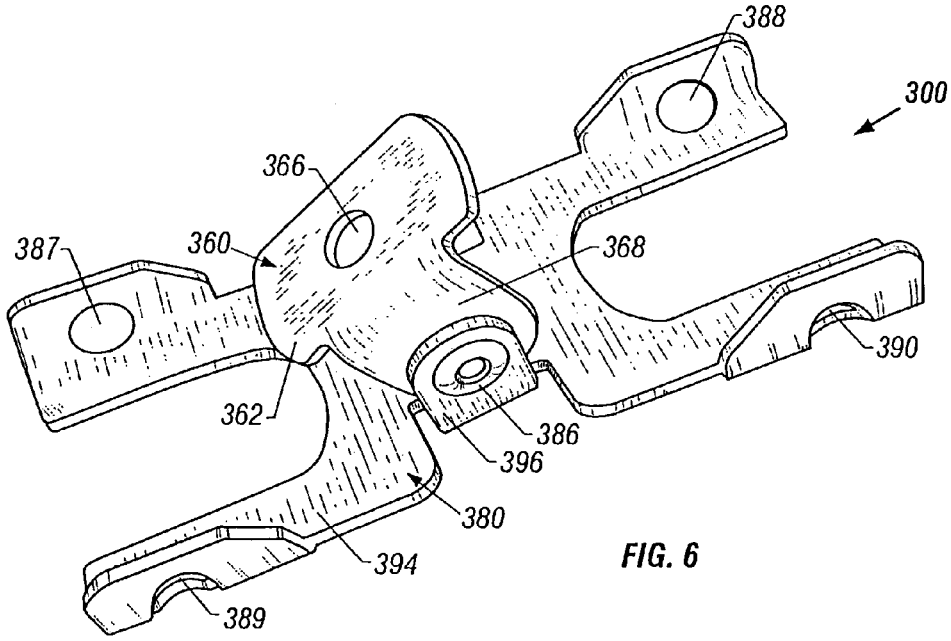
FIG. 6 is a perspective view of a hinge assembly including an H-shaped foot.

In yet another preferred embodiment, hinge assembly 300 as depicted in FIGS. 6, 7, 8 and 9 is useful for pivotally attaching an end-bored baluster 310 within groove 302 of a hand rail or a shoe rail. Hinge assembly 300 includes a plate 360 having a generally planar face 362. Plate 360 is adapted for inserting into and generally across the interior surface of the bore of baluster 310, and is preferably generally disk-shaped as depicted in FIG. 6. A pair of tabs 368 extend generally transversely and in parallel relationship from plate face 362, and each of the tabs 368 defines a first hole (not shown) for receiving a rivet 386.

Face 362 defines a hole 366 for receiving a wood screw (not shown) for fastening plate 360 to the inside surface of the bore 318 of baluster 310. Alternatively, the plate member 360 can be fastened to the inside surface by a nail, a molly bolt, a fluke, a grapple, or a barb. From these examples, it should be apparent that a user of hinge assembly 300 may require access to hole 366 at times when flange 380 is substantially obstructing bore 318.

Flange member 380 comprises generally H-shaped foot 394 and a pair of tabs 396, and defines port 382 for providing access to hole 366. The H-shape of foot 394 permits fillet 306 to be used full depth in groove 304, while also permitting fillet 306 to slide up to and abut baluster 310. Tabs 396 extend generally transversely and in parallel relationship from flange foot 394, each of the tabs 396 defining a second hole (not shown) for receiving rivet 386.

Figure 7:
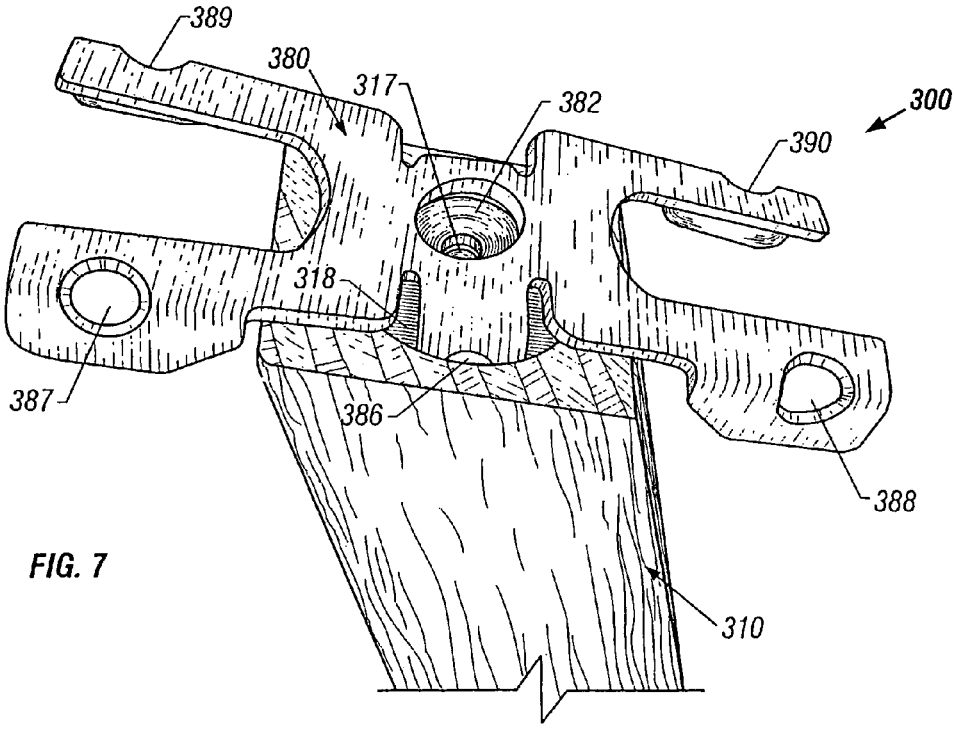
FIG. 7 is a partial perspective view of the hinge assembly depicted in FIG. 6 mounted on an end-bored baluster.

As best seen in FIGS. 6 and 7, tabs 368 nest in generally parallel alignment inside of tabs 396. This is useful, among other reasons, for preserving access through port 382 for final assembly adjustment of baluster 310 to rail 102.

A wood screw (not shown) is passed through port 382 and into hole 366 for attaching plate 360 to the inside surface 317 of baluster 310. The wood screw (not shown) is self-centering in bore 318, and may be accessed through port 382 for final assembly adjustment of baluster 310 to rail 102. The first and second holes defined respectively by tabs 368 and tabs 396, receive a pair of rivets 386 to pivotally attach plate 360 to flange 380. Alternatively, tabs 368 and tabs 396 can be pivotally attached by, for example, a cotter pin or a screwed fastener.

Figure 8:
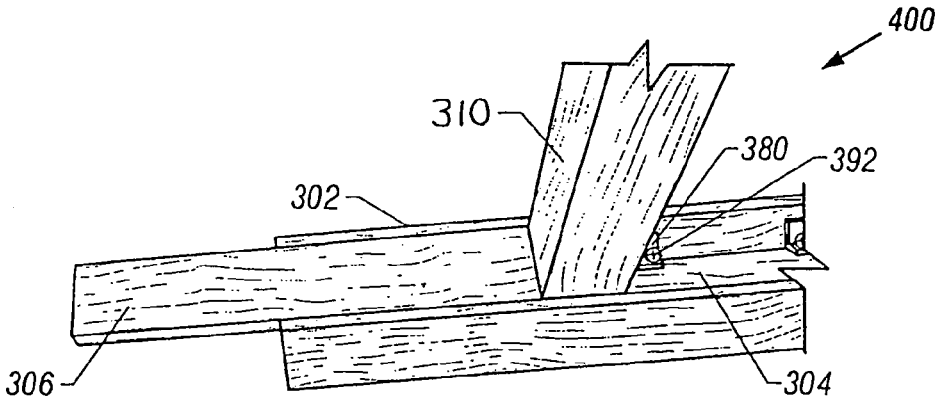
FIG. 8 is a partial perspective view of an adjustable stair rail system utilizing the hinge assembly depicted in FIG. 6.
Figure 9:
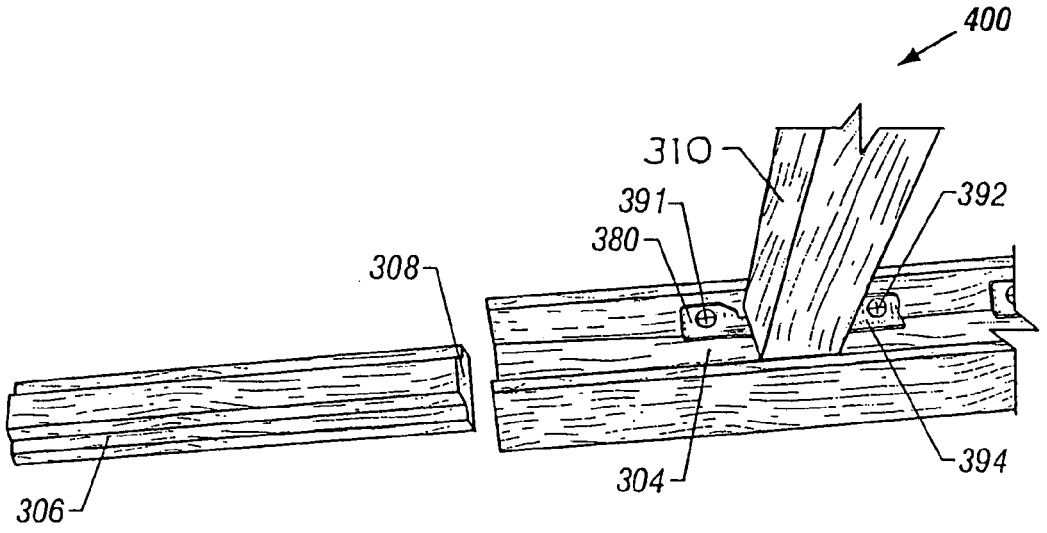
FIG. 9 is a partial perspective view of the adjustable stair rail system depicted in FIG. 8 with a fillet withdrawn for inspection.

An adjustable staircase system is provided by attaching hinge assembly 300 to a rail, such as rail 302. One such adjustable staircase system, designated system 400, is depicted in FIGS. 8 and 9. With baluster 310, plate 360 and flange 380 assembled and attached as described above to form hinge assembly 300, flange 380 is inserted into groove 304 defined by rail 302. Wood screws 391 and 392 (others not shown) pass respectively through openings 387, 388, 389 and 390 and fasten flange 380 to rail 302, as shown in FIG. 9. System 400 can be preassembled for delivery to a jobsite, and easily adjusted at the jobsite to any particular staircase rake within a range of up about 40 degrees. Practitioners will appreciate that hinge assembly 300 may be utilized successfully with, for example, a pin top or bottom baluster, a rectangular top or bottom baluster, a hand rail, a shoe rail or a cap rail.

FIG. 8 depicts system 400 with fillet 306 covering a portion of groove 304 adjacent baluster 310. FIG. 9 depicts groove 304 adjacent baluster 310, but with fillet 306 withdrawn and turned upside down so that its T-shaped cross-section 308 can be seen. T-shaped cross-section 308 permits fillet 306 to fit full depth into groove 304 and, also, to be solidly attached by field nailing. Preferably, the ends of fillet 306 are slightly tapered for a better fit when baluster 310 is adjusted with respect to rail 302. This taper can be factory cut upon one end of fillet 306 to save assembly time in the field. Also shown in FIG. 9 is the manner in which flange foot 394 of flange 380 is disposed within and attached to groove 304 of rail 302.

Figure 10:
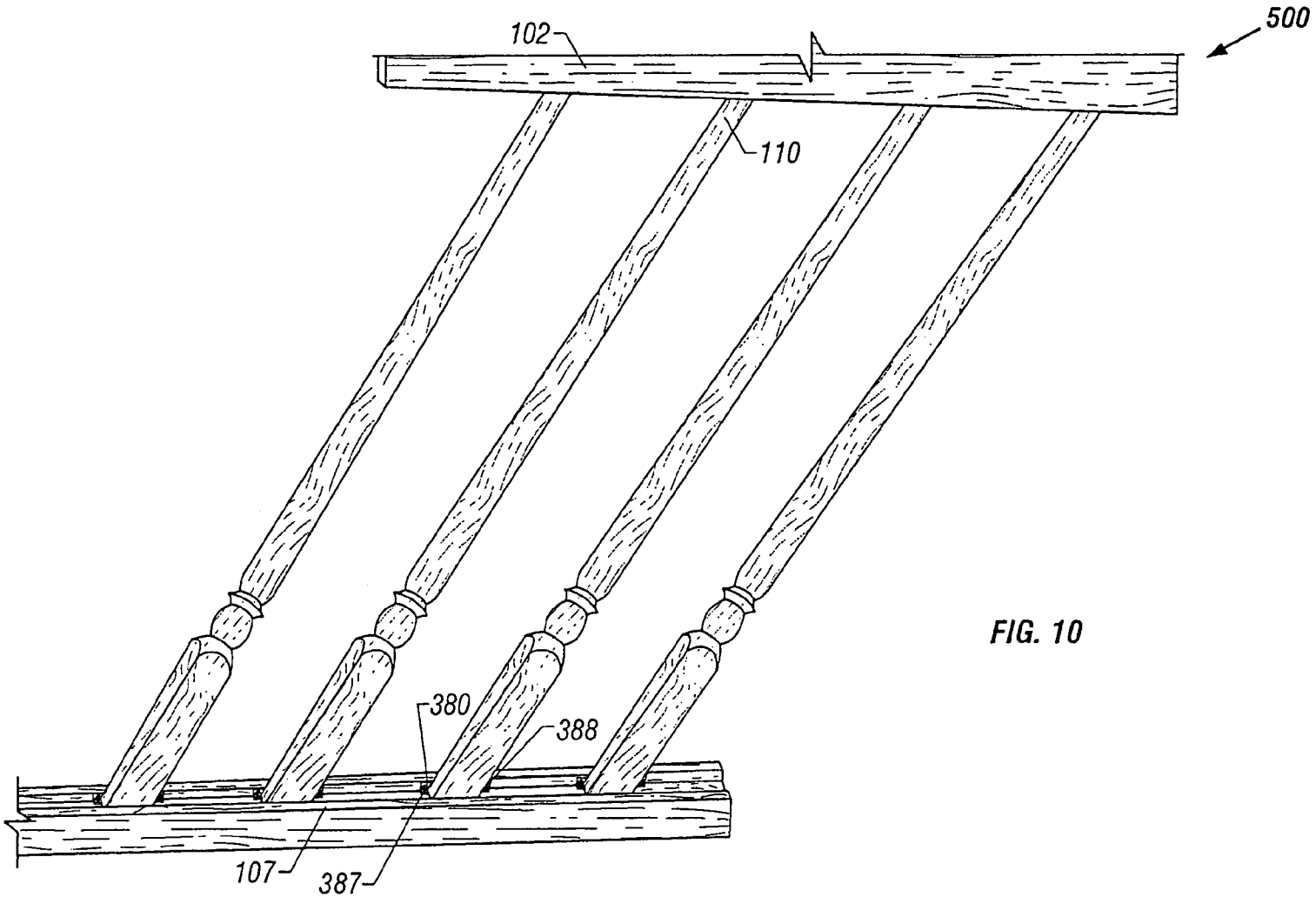
FIG. 10 is a perspective view of an adjustable stair rail system utilizing the hinge assembly depicted in FIG. 2 and the hinge assembly depicted in FIG. 6.

Either of the hinge assemblies 100 and 300 described above, or variations and modifications of these assemblies, can be used alone or in combination with each other to produce a variety of adjustable staircase rail systems. For example, adjustable staircase rail system 500, which is depicted in FIG. 10, utilizes assembly 100 for attaching the upper end of baluster 110 to hand rail 102 and assembly 300 for attaching the lower end of baluster 110. In other embodiments, assembly 100 can be used for attaching both the upper and lower ends of balusters 110 to the rails, or assembly 300 can be used at both the upper and lower ends of the baluster for attachment.

Baluster 110 is a pierced baluster having an upper end of circular cross-section (widely referred to as a "pin top") and a lower end which is end-bored and rectangular in cross-section. In this manner, system 500 combines the beauty of pin top balusters with the strength of rectangular balusters in a preassembled, adjustable system. System 500 can be stained and otherwise finished either before or after final adjustment and installation at the jobsite.

While a few, preferred aspects of the invention have been described above, those of ordinary skill in the art will recognize that any or all of these aspects may be modified without departing from the spirit and scope of the invention. The preferred aspects described above are to be considered as illustrative and not restrictive, the scope of the invention being indicated by the appended claims.

The invention claimed is:

1. A hinge assembly for adjustably attaching an end of a baluster to a rail in a staircase system, the hinge assembly comprising:

a generally flat plate adapted to be secured against a bottom face of a bore in the end of the baluster, the plate having an aperture for receiving a fastener to secure the plate against the bottom face of the bore;

at least one first tab extending generally transversely from the plate;

a generally flat flange adapted to be attached to the rail, the flange having an aperture therein for providing direct access to the plate to permit the plate to be secured against the bottom face of the bore;

at least one second tab protruding generally transversely from the flange; and a rivet disposed on its axis transversely in relation to the bore and hingedly connecting the at least one first tab to the at least one second tab for permitting the baluster to be pivoted relative to the flange and the rail through a substantial range of angles in correspondence to a range of selectable rake angles of the rail in the staircase system;

wherein the at least one first tab and the at least one second tab are substantially enclosed within the bore when said tabs are connected together.

2. A hinge assembly according to claim 1, wherein the flange comprises an H-shaped foot.

3. A hinge assembly according to claim 2, wherein the H-shaped foot is adapted to be attached to the rail within a groove in the rail.

4. A hinge assembly according to claim 1, wherein the end of the baluster is of a substantially circular cross-section.

* * * * *